US009101165B2

(12) United States Patent
Sashide et al.

(10) Patent No.: US 9,101,165 B2
(45) Date of Patent: Aug. 11, 2015

(54) CIGARETTE WITH INCREASED VOLATILE FLAVOR DELIVERY

(71) Applicant: JAPAN TOBACCO INC., Tokyo (JP)

(72) Inventors: Fumio Sashide, Tokyo (JP); Tatsuya Kusakabe, Tokyo (JP); Yasuo Tanaka, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 331 days.

(21) Appl. No.: 13/626,587

(22) Filed: Sep. 25, 2012

(65) Prior Publication Data

US 2013/0019884 A1 Jan. 24, 2013

Related U.S. Application Data

(63) Continuation of application No. PCT/JP2010/055458, filed on Mar. 26, 2010.

(51) Int. Cl.

| | |
|---|---|
| ***A24B 15/30*** | (2006.01) |
| ***A24D 1/00*** | (2006.01) |
| ***A24B 15/28*** | (2006.01) |

(52) U.S. Cl.

CPC ..... *A24D 1/002* (2013.01); *A24B 15/283* (2013.01); *A24B 15/30* (2013.01)

(58) Field of Classification Search

None

See application file for complete search history.

(56) References Cited

U.S. PATENT DOCUMENTS

| | | | | |
|---|---|---|---|---|
| 3,902,504 A | | 9/1975 | Owens, Jr. et al. | |
| 4,595,024 A | | 6/1986 | Greene et al. | |
| 4,716,913 A | | 1/1988 | Brackmann | |
| 4,730,628 A | | 3/1988 | Townsend et al. | |
| 4,759,380 A | | 7/1988 | Norman et al. | |
| 4,896,681 A | | 1/1990 | Brackmann et al. | |
| 4,913,166 A | * | 4/1990 | Christensson et al. | 131/31 |
| 5,074,321 A | | 12/1991 | Gentry et al. | |
| 6,658,822 B1 | * | 12/2003 | Dittrich | 53/474 |

(Continued)

FOREIGN PATENT DOCUMENTS

| | | |
|---|---|---|
| EP | 0468298 A1 | 1/1992 |
| JP | 50-58300 | 5/1975 |
| JP | 61-108364 A | 5/1986 |

(Continued)

OTHER PUBLICATIONS

English translation of International Preliminary Report on Patentability and Written Opinion issued Nov. 1, 2012, in PCT International Application No. PCT/JP2010/055458.

(Continued)

*Primary Examiner* — Richard Crispino
*Assistant Examiner* — Phu Nguyen
(74) *Attorney, Agent, or Firm* — Birch, Stewart, Kolasch & Birch, LLP

(57) ABSTRACT

A cigarette includes a tobacco rod in which a tobacco filler containing cut tobacco is wrapped with a cigarette paper, the tobacco rod being constituted by a distal end portion, a proximal end portion and a center portion, and a filter, the proximal end portion being connected to the filter. The distal end portion includes a volatile flavor-containing material incorporated in a gel of a polysaccharide, the center portion includes or does not include the volatile flavor-containing material, the proximal end portion includes or does not include the volatile flavor-containing material, and there is no case where both the center portion and the proximal end portion include the volatile flavor-containing material.

8 Claims, 6 Drawing Sheets

(56) References Cited

U.S. PATENT DOCUMENTS

| | | | | |
|---|---|---|---|---|
| 2009/0011238 | A1* | 1/2009 | Rheinlander et al. | 428/402 |
| 2009/0038629 | A1* | 2/2009 | Ergle et al. | 131/276 |

FOREIGN PATENT DOCUMENTS

| | | | |
|---|---|---|---|
| JP | 62-190070 | A | 8/1987 |
| JP | 1-128777 | A | 5/1989 |
| JP | 3-50892 | U | 5/1991 |
| JP | 3-175968 | A | 7/1991 |
| JP | 6-209756 | A | 8/1994 |
| JP | 9-28366 | A | 2/1997 |

OTHER PUBLICATIONS

PCT/ISA/210—International Search Report mailed on Jun. 29, 2010, issued in PCT/JP2010/055458.

PCT/ISA/237—Written Opinion of the International Searching Authority mailed on Jun. 29, 2010, issued in PCT/JP2010/055458.

* cited by examiner

CIGARETTE WITH INCREASED VOLATILE FLAVOR DELIVERY

CROSS REFERENCE TO RELATED APPLICATIONS

This application is a Continuation Application of PCT Application No. PCT/JP2010/055458, filed Mar. 26, 2010, the entire contents of which are incorporated herein by reference.

BACKGROUND OF THE INVENTION

1. Field of the Invention

The present invention relates to a cigarette with an increased amount of volatile flavor delivery in smoke at the time of the initial puff.

2. Description of the Related Art

A menthol cigarette is generally produced by adding menthol flavor to cut tobacco, and processing the cut tobacco into a cigarette by using a tobacco rolling machine. In such menthol cigarette, it is known that the amount of menthol that is fed to the mouth at every puff gradually increases from the initial puff to the completion of smoking. Namely, the amount of menthol that is fed to the mouth at the initial period of smoking (at the times of the first and second puff) is smaller than that in the later period of smoking. By this fact, a smoker feels insufficient menthol feeling at the initial period of smoking. It is considered that the delivery amount of the menthol in the smoke is increased by simply increasing the amount of menthol with which cut tobacco is impregnated, but the above-mentioned problem of gradual increase cannot be solved by this technique, and if menthol is added by a too much amount, it is likely that the menthol that has been excessively added exudes on the cigarette paper, which consequently contaminates the package of the product. Furthermore, since menthol is volatile, there is a problem under conventional flavor-adding processes that menthol volatilizes during storage and a desired amount of menthol is not released at the time of smoking.

Meanwhile, various techniques relating to cigarettes aiming at controlling the delivery amount of a tobacco-derived component and smoke flavor have been known since before. For example, European Patent Publication No. 468298 discloses a cigarette constitution in which a tobacco rod is constituted by two sections and different types of tobacco fillers are used in the respective sections. U.S. Pat. No. 4,759,380 discloses a constitution in which cut tobacco of good quality is disposed in the distal end portion of a cigarette and inexpensive cut tobacco is disposed in the proximal end portion. Jpn. Pat. Appln. KOKAI Publication No. 61-108364 discloses a technique for improving feeling of satisfaction at the initial period of smoking by disposing cut tobacco containing a high content of nicotine in the distal end portion of a tobacco rod.

Furthermore, U.S. Pat. No. 4,730,628 discloses a segment-type cigarette in which the density of cut tobacco at the distal end has been increased so as to suppress the tip dropping of the cut tobacco. Jpn. Pat. Appln. KOKAI Publication No. 62-190070 discloses a design and a method for the production of a cigarette by which a smoke flavor/tar ratio at the initial period of smoking is increased more than that in conventional cigarettes and homogeneous smoke flavor can be provided at the time of smoking, by disposing tobacco having high smoke flavor in the distal end portion of the tobacco rod.

Furthermore, Jpn. Pat. Appln. KOKAI Publication No. 01-128777 and Jpn. Pat. Appln. KOKAI Publication No. 06-209756 disclose segmented cigarettes. Furthermore, Jpn. UM Appln. KOKAI Publication No. 03-50892 discloses a cigarette comprising segments respectively containing different flavors.

As mentioned above, various techniques for controlling the smoke flavor of tobacco at the initial period of smoking can be found, but there is no cigarette that can enhance the menthol feeling at the initial period of smoking, prevent exuding of menthol on a cigarette paper during storage and significantly maintain the delivery amount of menthol at the time of smoking even after storage.

BRIEF SUMMARY OF THE INVENTION

The object of the present invention is to provide a cigarette by which the delivery amount of a volatile flavor contained in smoke at the time of the initial puff is increased, exuding of the volatile flavor is not generated during storage, and a desired delivery amount of the volatile flavor is maintained at the time of smoking after the storage.

The present inventors have obtained a cigarette that solves the above-mentioned problem by disposing a tobacco filler mixed with a volatile flavor-containing material incorporated in a polysaccharide in a specific portion of a tobacco rod.

Namely, according to an aspect of the present invention, there is provided a cigarette comprising: a tobacco rod in which a tobacco filler containing cut tobacco is wrapped with a cigarette paper, the tobacco rod being constituted by a distal end portion, a proximal end portion and a center portion; and a filter, the proximal end portion being connected to the filter, wherein the distal end portion comprises a volatile flavor-containing material incorporated in a gel of a polysaccharide, the center portion comprises the volatile flavor-containing material or does not comprise the volatile flavor-containing material, the proximal end portion comprises the volatile flavor-containing material or does not comprise the volatile flavor-containing material, and there is no case where both the center portion and the proximal end portion comprise the volatile flavor-containing material.

Provided is a cigarette by which the delivery amount of a volatile flavor contained in smoke at the time of the initial puff is increased, exuding of the volatile flavor is not generated during storage, and a desired delivery amount of the volatile flavor is maintained at the time of smoking after the storage.

DETAILED DESCRIPTION OF THE INVENTION

Figure 1:
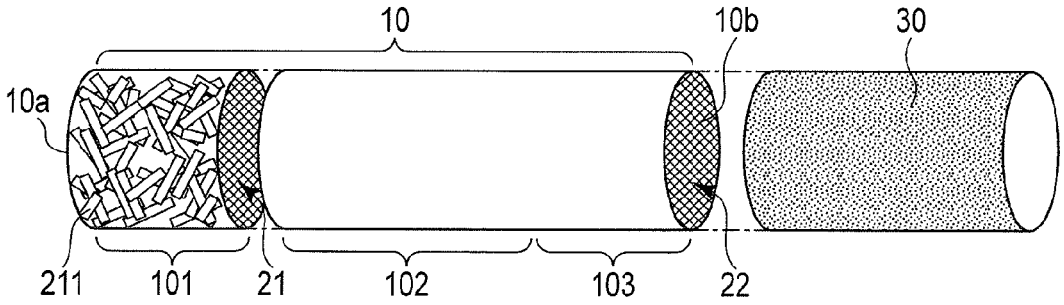
FIG. 1 is a schematic view of a cigarette of the present invention in which a first tobacco filler is disposed in only a distal end portion.

One feature of the cigarette of the present invention is that a tobacco filler mixed with a flavor-containing material comprising a volatile flavor contained a polysaccharide is disposed in a specific portion of a tobacco rod.

The flavor-containing material used in the present invention is described in WO 2009/142159 together with the production process therefor. Namely, various flavors can be used as the volatile flavor, and for example, 1-menthol can be used.

As the polysaccharide, preferred is a single component system of carrageenan, agar, gellan gum, tamarind gum, psyllium seed gum or konnyaku glucomannan, or a composite system of a combination of two or more components selected from the group consisting of carrageenan, locust bean gum, guar gum, agar, gellan gum, tamarind gum, xanthane gum, tara gum, konnyaku glucomannan, starch, cassia gum and psyllium seed gum. Furthermore, during emulsification therefor, it is preferable to use a generally used emulsifier such as lecithin in combination.

Since the polysaccharide used in the present invention can be gelled by only heating at 30 to 90° C. in an aqueous solution, a gellation reaction agent for gelling the polysaccharide is not necessary.

A volatile flavor-containing material that is prepared by kneading and emulsifying a flavor and a polysaccharide in an aqueous solution can be formed into a sheet by casting on a suitable support and drying. This volatile flavor-containing material sheet can be cut into a similar size to that of cut tobacco and added to the cut tobacco. Furthermore, the tobacco filler can also be used for a cigarette by wrapping the tobacco filler with the sheet-like volatile flavor-containing material.

The volatile flavor-containing material can be prepared by a method comprising the steps of:

(i) mixing a polysaccharide and water, and heating the mixture to prepare an aqueous solution of the polysaccharide, and (ii) adding a flavor and an emulsifier to the above-mentioned aqueous solution, and kneading and emulsifying the aqueous solution.

In the step (i), the polysaccharide and water are mixed and heated. The heating temperature is 30 to 90° C., desirably 60 to 90° C.

Next, in the step (ii), the flavor and emulsifier are added to the above-mentioned aqueous solution of the polysaccharide, and kneading and emulsifying the aqueous solution. By this way, a material having a high flavor content in the volatile flavor-containing material can be prepared. Namely, a smoking article carrying this volatile flavor-containing material can generate higher aroma at the time of smoking.

The volatile flavor content of the volatile flavor-containing material is preferably 18% by weight or more, more preferably 60% or more, specifically 70% or more.

Meanwhile, the cigarette of the present invention comprises the above-mentioned volatile flavor-containing material in the tobacco rod, and the tobacco rod is constituted by a distal end portion, a proximal end portion, and a center portion. The tobacco rod is prepared by wrapping the tobacco filler with a cigarette paper, the distal end portion of the tobacco rod is a region comprising an ignition end of the tobacco rod, the proximal end portion of the tobacco rod is a region comprising an end that contacts with a filter, and the center portion of the tobacco rod is a region present between the distal end portion and proximal end portion. In these regions, different regions may be physically divided or may constitute an integrated tobacco rod without being divided.

The full length of the tobacco rod is 49 to 70 mm, more specifically 53 mm, 57 mm, 68 mm or the like.

Furthermore, the distal end portion accounts for 0.018 to 2.25% of the full length of the tobacco rod, and the proximal end portion accounts for 0.018 to 2.25% of the full length of the tobacco rod. Preferably, the distal end portion accounts for 8.8 to 35.1% of the full length of the tobacco rod, and the proximal end portion accounts for 8.8 to 35.1% of the full length of the tobacco rod. Further preferably, the distal end portion accounts for 17.5% of the full length of the tobacco rod, and the proximal end portion accounts for 17.5% of the full length of the tobacco rod.

The volatile flavor-containing material of the present invention is always present in the distal end portion of the tobacco rod and is optionally present in the center portion and proximal end portion, but is not present in the entire region (distal end portion and center portion and proximal end portion) of the tobacco rod.

Meanwhile, the volatile flavor-containing material of the present invention may be wrapped inside or outside of the cigarette paper that constitutes the tobacco rod, or may be incorporated in the tobacco filler that also constitutes the tobacco rod. Namely, the expression "comprising a volatile flavor-containing material" in the present invention includes the case where the volatile flavor-containing material is disposed inside or outside of the cigarette paper, and an embodiment in which the volatile flavor-containing material is incorporated in the tobacco filler.

The tobacco filler of the present invention is a first tobacco filler comprising the above-mentioned volatile flavor-containing material and general cut tobacco, or a second tobacco filler composed of a general tobacco filler (cut tobacco and the like) that is free from the volatile flavor-containing material.

The first tobacco filler and second tobacco filler may further contain a tobacco powder obtained by pulverizing leaf tobacco, or a leaf tobacco component such as a leaf tobacco extract. Furthermore, the first tobacco filler and second tobacco filler may contain other tobacco material, flavoring agent and/or moisturizing agent in addition to leaf tobacco or a leaf tobacco component. The types of tobacco leaf may include burley tobacco, flue-cured tobacco, oriental tobacco and the like.

In the cigarette of the present invention, there is no case where both the center portion and proximal end portion comprise the volatile flavor-containing material, but a volatile flavor same as the volatile flavor contained in the volatile flavor-containing material may be added to the center portion or proximal end portion that does not comprise volatile flavor-containing material. However, preferable embodiments of the present invention are the following a) to c).

a) A cigarette comprising a distal end portion that has a volatile flavor-containing material, and a center portion and a proximal end portion which do not comprise the same volatile flavor as the volatile flavor contained in the volatile flavor-containing material.

b) A cigarette comprising a distal end portion and a center portion which have a volatile flavor-containing material, and a proximal end portion that does not comprise the same volatile flavor as the volatile flavor contained in the volatile flavor-containing material.

c) A cigarette comprising a distal end portion and a proximal end portion which have a volatile flavor-containing material, and a center portion that does not comprise the same volatile flavor as the volatile flavor contained in the volatile flavor-containing material.

In the case where the volatile flavor-containing material is incorporated in the tobacco filler, the tobacco filler contained in the tobacco rod is constituted by the first tobacco filler and second tobacco filler. Namely, the above-mentioned cigarettes of a) to c) can be obtained by suitably changing the disposition of the first tobacco filler incorporating the volatile flavor-containing material.

In particular, of the above-mentioned c), a cigarette in which the first tobacco filler is disposed in the distal end portion and proximal end portion, and the second tobacco filler is disposed in the center portion is preferable.

Furthermore, a cigarette in which the first tobacco filler is disposed in the distal end portion and proximal end portion and the second tobacco filler is disposed in the center portion, wherein the distal end portion accounts for 17.5% of the full length of the tobacco rod and the proximal end portion accounts for 17.5% of the full length of the tobacco rod is the most preferable. By forming the cigarette into such constitution, the delivery amount of the volatile flavor contained in the smoke at the time of the initial puff can be unexpectedly increased more.

On the other hand, in the case where the volatile flavor-containing material is wrapped inside or outside of the cigarette paper, the entirety of the tobacco filler contained in the tobacco rod is constituted by the second tobacco filler. In this case, the above-mentioned cigarettes of a) to c) can be obtained by suitably changing the disposition of the sheet-like volatile flavor-containing material.

The amount of the volatile flavor-containing material contained in the entirety of the tobacco rod is 1 to 300 mg (0.16 to 50%), preferably 6 to 100 mg (1 to 17%). On the other hand, the amount of the volatile flavor contained in the entirety of the tobacco rod is 0.75 to 225 mg (0.125 to 37.5%), preferably 4.5 to 75 mg (0.75 to 12.5%). Furthermore, the content of the volatile flavor per unit length of the region in which the volatile flavor-containing material is contained is 0.037 to 24 mg/mm, preferably 0.225 to 7.5 mg/mm.

Meanwhile, in the cigarette of the invention, one can enjoy the taste of the volatile flavor after the distal end portion comprising the volatile flavor-containing material has burned out, even in the case where the center portion and proximal end portion do not comprise the volatile flavor. This is because a relatively large amount of the volatile flavor that is generated when the distal end portion comprising the volatile flavor-containing material is smoked is adsorbed by the tobacco filler in the center portion and proximal end portion.

The cigarette according to an embodiment of the present invention can be produced by charging an automatic rolling machine with a first tobacco filler comprising cut tobacco and a volatile flavor-containing material that has been cut into a similar size to that of the cut tobacco, and a second tobacco filler, disposing the first tobacco filler on a distal end portion and disposing the second tobacco filler on a center portion and a proximal end portion, or disposing the first tobacco filler on the distal end portion and center portion and disposing the second tobacco filler on the proximal end portion, or disposing the first tobacco filler on the distal end portion and proximal end portion and disposing the second tobacco filler on the center portion, wrapping the tobacco fillers with a cigarette paper to prepare a tobacco rod, and connecting this to a filter with a tipping paper.

The cigarette according to an embodiment of the present invention can be produced by charging an automatic rolling machine with a second tobacco filler, wrapping a tobacco rod by using a cigarette paper in which a sheet-like volatile flavor-containing material is laminated inside so that the sheet-like volatile flavor-containing material is disposed in only the distal end portion of the tobacco rod, or disposed in the distal end portion and center portion of the tobacco rod, or disposed in the distal end portion and proximal end portion of the tobacco rod, and connecting this to a filter with a tipping paper.

Alternatively, the cigarette can be produced by charging an automatic rolling machine with a second tobacco filler, wrapping a tobacco rod in a general cigarette paper, wrapping only the distal end portion, or the distal end portion and center portion, or the distal end portion and proximal end portion with a sheet-like volatile flavor-containing material to prepare a tobacco rod, and connecting this to a filter with a tipping paper.

Next, the present invention will be described in detail with reference to the drawings.

FIGS. 1 to 8 show cigarettes each comprising a tobacco rod 10 and a filter 30. The tobacco rod 10 comprises a distal end portion 101 comprising a distal end 10*a*, a proximal end portion comprising a proximal end 10*b* and a center portion 102 positioned between the distal end portion and proximal end portion, and the proximal end 10*b* is contacted with the filter 30. The tobacco rod 10 is obtained by wrapping a tobacco filler with a cigarette paper (not depicted) and is connected to the filter 30 with a tipping paper (not depicted), thereby processed into a cigarette.

FIG. 1 shows the cigarette of the present invention in which a first tobacco filler 21 is disposed in a distal end portion 101 of a tobacco rod 10, and a second tobacco filler 22 is disposed in a center portion 102 and a proximal end portion 103. Here, the first tobacco filler 21 comprises cut tobacco (not depicted) and a volatile flavor-containing material 211, wherein the volatile flavor-containing material 211 is dispersed homogeneously in the first tobacco filler 21.

Figure 2:
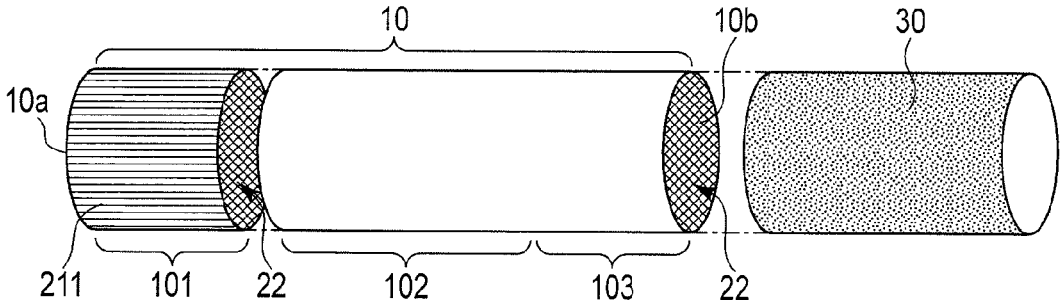
FIG. 2 is a schematic view of a cigarette of the present invention in which only a distal end portion is wrapped with a volatile flavor-containing material.

FIG. 2 shows the cigarette of the present invention in which a second tobacco filler 22 that is free from a volatile flavor-containing material is disposed in the entire region of a tobacco rod 10, and a distal end portion 101 of the tobacco rod 10 is wrapped with a sheet-like volatile flavor-containing material 211. The volatile flavor-containing material 211 is present inside or outside of a cigarette paper (not depicted).

Figure 3:
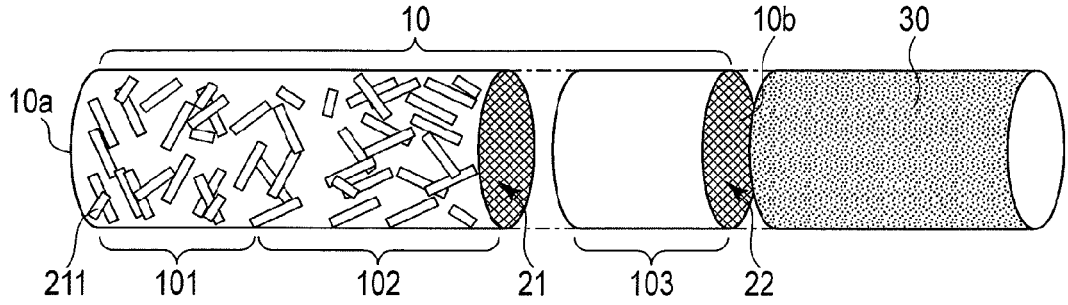
FIG. 3 is a schematic view of a cigarette of the present invention in which a first tobacco filler is disposed in a distal end portion and a center portion, and a second tobacco filler is disposed in a proximal end portion.

FIG. 3 shows the cigarette of the present invention in which a first tobacco filler is disposed in a distal end portion and a center portion, and a second tobacco filler is disposed in a proximal end portion.

Figure 4:
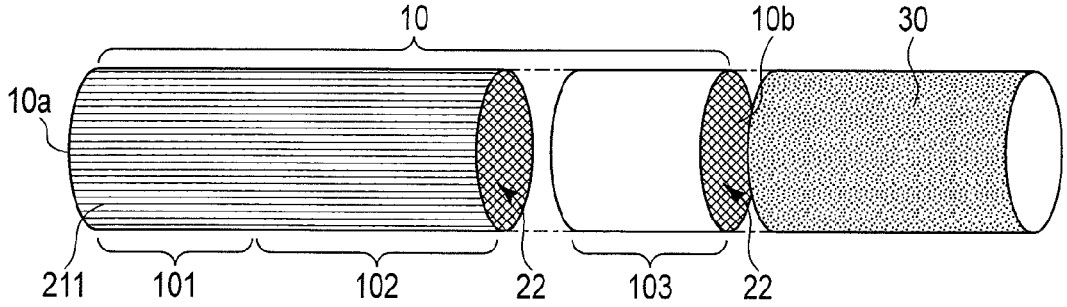
FIG. 4 is a schematic view of a cigarette of the present invention in which a distal end portion and a center portion thereof are wrapped with a volatile flavor-containing material.

FIG. 4 shows the cigarette of the present invention in which a second tobacco filler 22 is disposed in the entire region of a tobacco rod 10, and a distal end portion 101 and a center portion 102 of the tobacco rod 10 are wrapped with a sheet-like volatile flavor-containing material 211.

Figure 5:
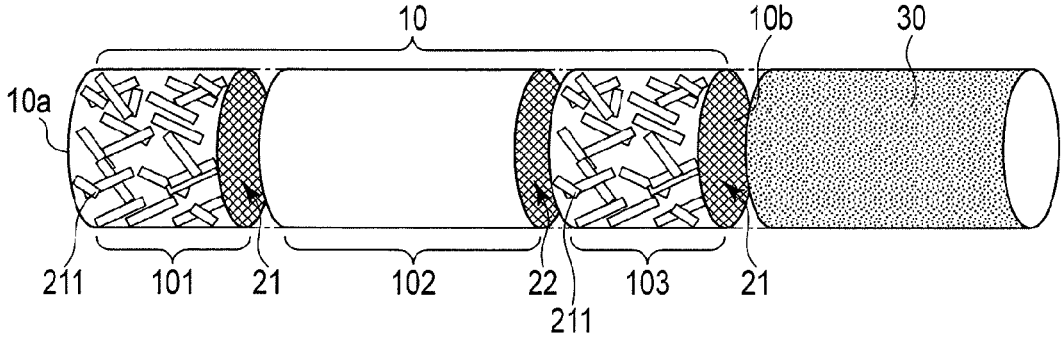
FIG. 5 is a schematic view of a cigarette of the present invention in which a first tobacco filler is disposed in a distal end portion and a proximal end portion, and a second tobacco filler is disposed in a center portion.

FIG. 5 is the cigarette of the present invention in which a first tobacco filler is disposed in a distal end portion and a proximal end portion, and a second tobacco filler is disposed in a center portion.

Figure 6:
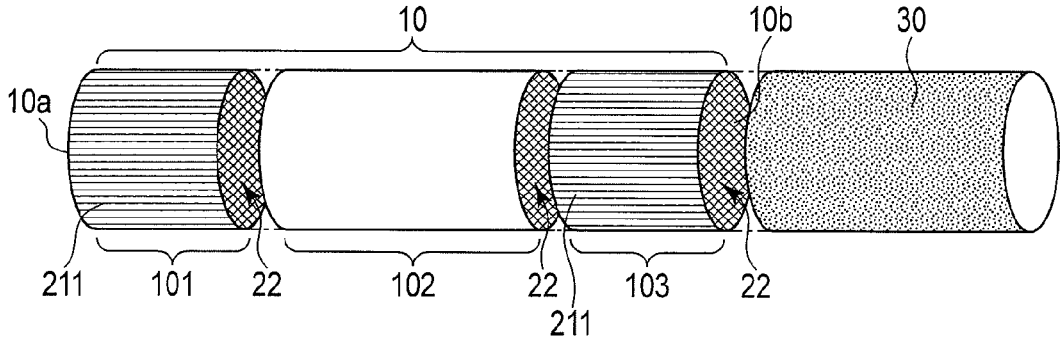
FIG. 6 is a schematic view of a cigarette of the present invention in which a distal end portion and a central proximal end portion thereof are wrapped with a volatile flavor-containing material.
Figure 7:
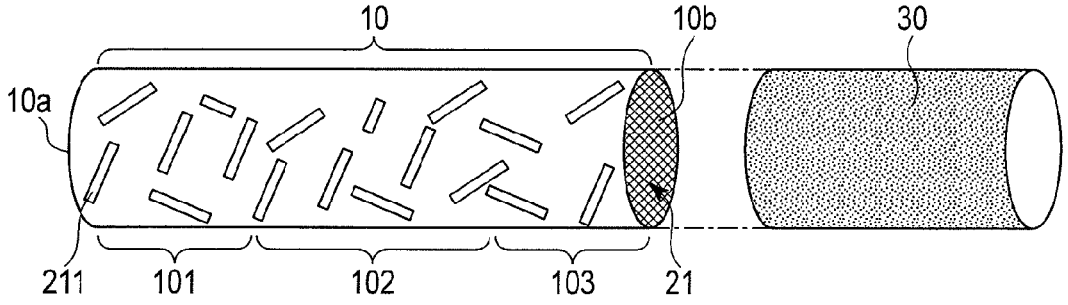
FIG. 7 is a schematic view of a cigarette of Comparative Example in which a first tobacco filler is disposed in the entire region of a tobacco rod.
Figure 8:
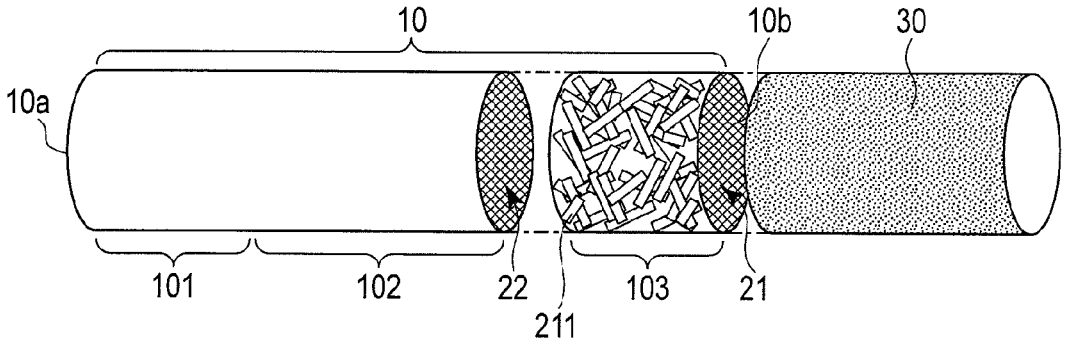
FIG. 8 is a schematic view of a cigarette of Comparative Example in which a first tobacco filler is disposed in a proximal end portion, and a second tobacco filler is disposed in a distal end portion and a center portion.

FIG. 6 shows the cigarette of the present invention in which a second tobacco filler 22 is disposed in the entire region of a tobacco rod 10, and a distal end portion 101 and a proximal end portion 103 of the tobacco rod 10 are wrapped with a sheet-like volatile flavor-containing material 211.

In either of the cases of FIGS. 1 to 8, the total amount of the volatile flavor contained in the tobacco rod 10 is constant.

Next, the properties of the cigarettes of the present invention will be verified in the following Examples and Comparative Examples.

EXAMPLES

Example 1

[Preparation of Volatile Flavor-Containing Material]

As a polysaccharide, a composite system prepared by mixing gellan gum that is a polysaccharide generated by the metabolism of a microorganism (KELCOGEL by CP Kelco U.S. Inc.) and tamarind gum having a xyloglucan structure which is extracted from seeds of a timber (BISTOP D-2032 by San-Ei Gen F. F. I., Inc.) in a weight ratio of 1:1 was selected, 1-menthol was selected as a flavor, and a volatile flavor-containing material was prepared by the following procedures.

100 mL of water was added to 1.0 g of gellan gum and 1.0 g of tamarind gum, which was heated in a thermostatic water bath at 80° C. to dissolve the above-mentioned polysaccharides sufficiently in water. To this were added 10 g of 1-menthol and 1.6 mL of a 5% aqueous solution of lecithin as an emulsifier, which was emulsified sufficiently with a homogenizer. The emulsified slurry was casted in a sheet-like form on a suitable support and dried for 1 week in a forced air circulation drier at 40° C. At that time, the emulsified state of the mixture was maintained until the volatile flavor-containing material was dried.

When the resultant volatile flavor-containing material was measured according to the measurement procedures described below, it had the composition shown in the following Table 1.

TABLE 1

Composition of volatile flavor-containing material

| Material name | Ratio (% by mass) |
|---|---|
| Menthol | 74.9 |
| Gellan gum | 7.49 |
| Tamarind gum | 7.49 |
| Lecithin | 0.15 |
| Water | 10.0 |

[Preparation of Sample Cigarette]

A first tobacco filler (ratio of the volatile flavor-containing material: 17% by weight) was prepared by mixing at a ratio of 21 mg of the volatile flavor-containing material that was prepared by the above procedures with respect to 102 mg of general blend cut tobacco. An automatic rolling machine was charged with the first tobacco filler and a second tobacco filler (the above general blend cut tobacco). Thereafter the tobacco fillers were wrapped with a cigarette paper so that the first tobacco filler is disposed in the distal end portion (length: 10 mm (17.5% of the full length of the tobacco rod)) and the second tobacco filler is disposed in the center portion and proximal end portion (total length: 47 inn (82.5% of the full length of the tobacco rod)). Subsequently, this tobacco rod was connected to a filter (27 mm) with a tipping paper to prepare a cigarette (FIG. 1).

The obtained cigarette was smoked, and the amount of menthol contained in smoke was measured at every number of puffs according to the measurement procedures described below. Furthermore, a similar determination was performed for a cigarette that had been stored for one month after preparation.

[Procedure for Measurement of Amount of Menthol]

The procedures for measuring the amount of the menthol in the above-mentioned volatile flavor-containing material, and the amount of the menthol contained in the smoke of the cigarette are shown below.

(1) Extraction of Components (1-1) Extraction of Components in Volatile Flavor-Containing Material Sheet The volatile flavor-containing material sheet prepared by the above-mentioned procedures was cut into a cut length of about 10 mm and a cut width of about 1 mm with scissors, and about 0.1 g was weighed precisely and put into a serum bottle. 10 mL of methanol (for HPLC, manufactured by Wako) as an extraction solvent was added to this serum bottle, a rubber stopper was put in the serum bottle, and the serum bottle was further sealed by using PARAFILM (registered trademark). This was shaken in a shaker at 200 rpm for 40 minutes, stood still once for 12 hours or more, and shaken again in the shaker for 40 minutes. This was stood still for 5 minutes, and the supernatant solution was put into a brown vial with a Pasteur pipette. Since the extract liquid had a high concentration, it was diluted 10 fold prior to analysis.

(1-2) Extraction of Components in Smoke

Using a ten channel linear smoking machine (AM410, Ceruiean), smoke was collected under smoking conditions of a smoking volume of 35 mL/2 sec and a puff interval of 60 seconds. The burning length of the cigarette was 49 mm from the distal end of an ignition part, and smoke was collected at every number of puffs on a Cambridge filter (Bolgwaldt, 44 mm in diameter) at 7 times of smoking (since there may be a tobacco rod that does not need 8 or more of puffs, the number of puffs was set to 7 times in this case).

The plural filters in which the smoke at the respective numbers of puffs had been collected were each put into a serum bottle vial and extracted with 10 mL of 2-propanol for 20 minutes. The obtained supernatant solution at every number of puffs was put into a brown vial with a Pasteur pipette. The components extracted are mainly menthol, water and nicotine.

(2) Measurement by Gas Chromatography (GC-FID)

The extracted solution that had been put into the vial by the above-mentioned procedures was fed to GC-FID (manufactured by Agilent), analyzed simultaneously with absolute standard curve five points, and the amounts of menthol in the volatile flavor-containing material sheet and smoke (mg/mL) were determined from the values of peak areas. As samples for the preparation of the standard curve, five solutions 1 to 5 for the standard curve, 0.1 mg to 10 mg/mL solutions, were prepared by suitably changing the concentration of a primary stock solution (50 mg/mL methanol). As the washing solvent during the GS measurement, methanol was used for the menthol in the volatile flavor-containing material, and 2-propanol was used for the menthol in the smoke.

(3) Results and Discussion (3-1) Preparation of Standard Curve

Figure 9:
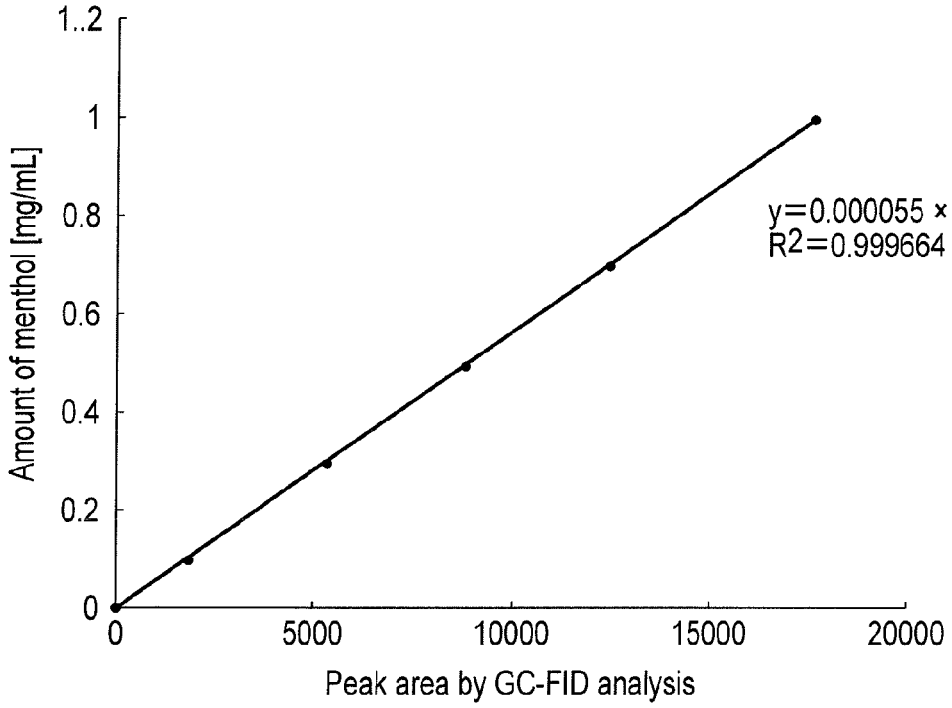
FIG. 9 is a graph of a standard curve that was used for the determination of the amounts of the menthol.

The standard curve of menthol obtained from the measured data is shown in FIG. 9. When the range of the standard curve was adjusted to a range up to 1.0 mg/mL and linear approximation was applied to the previous five points of measurement values under a condition that the line passes the origin, the measurement values and approximated values (standard curve) showed high correlation ($R^2$=0.999664). Namely, this standard curve could be used for the determination of menthol with high reliability.

(3-2) Determination of Menthol

Figure 10:
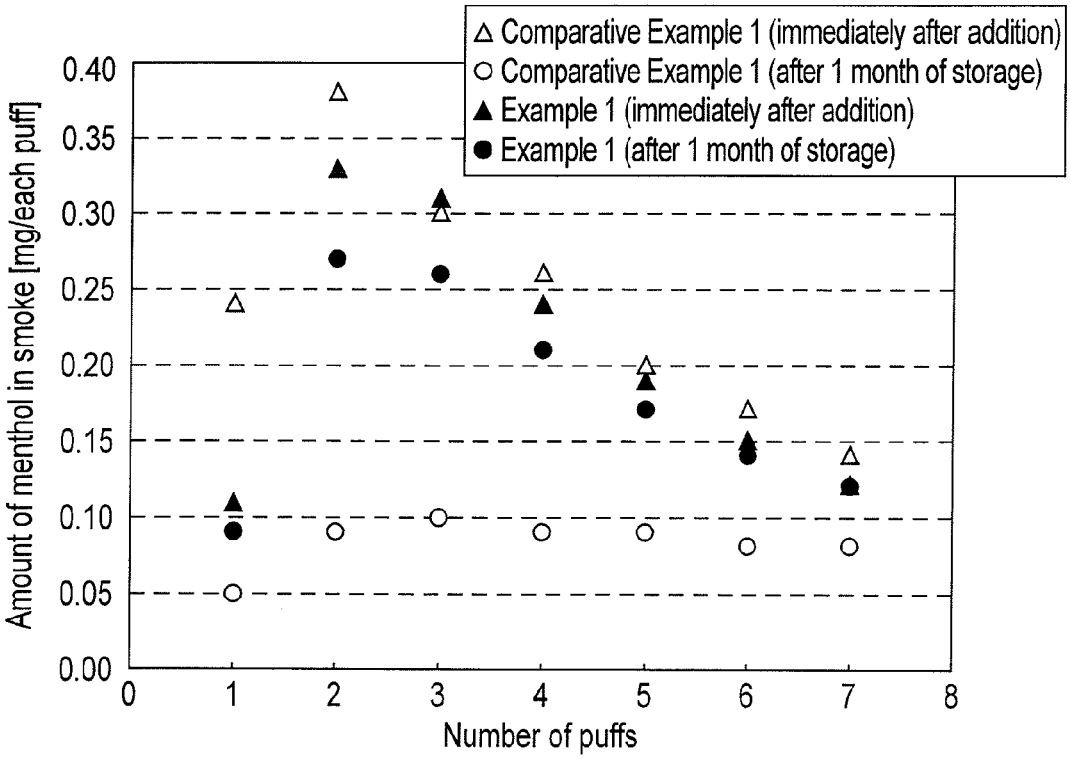
FIG. 10 is a graph obtained by measuring the amounts of the menthol in the smoke for the cigarette immediately after preparation and the cigarette after one month of storage at every number of puffs.
Figure 11:
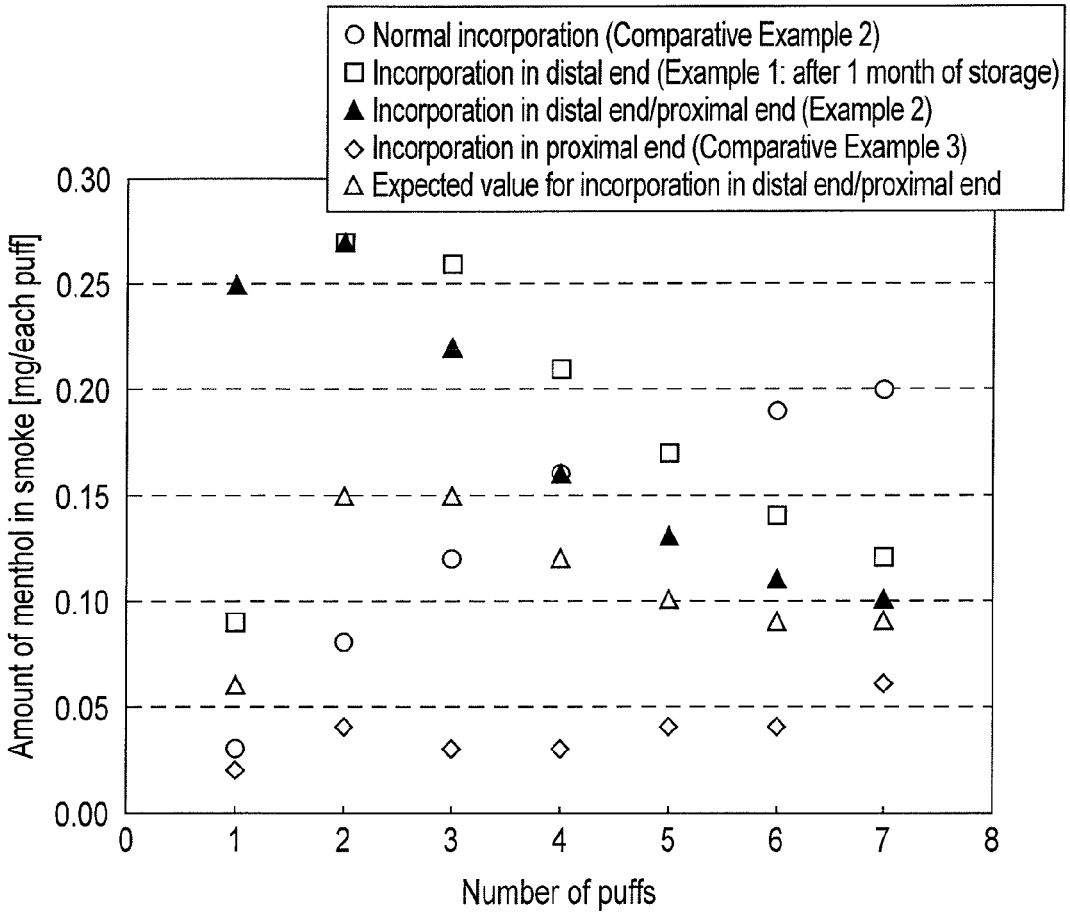
FIG. 11 is a graph obtained by storing various cigarettes that were prepared by changing the arrangement of the first tobacco filler and the cigarette of Comparative Example for one month, and measuring the amount of the menthol in the smoke for each cigarette at every number of puffs.

Using the standard curve obtained by the above-mentioned procedures, the menthol in the volatile flavor-containing material and the menthol in the smoke were determined based on the analyzed values for the menthol in the samples which were measured in (2). Specifically, the results of the determination of the menthol in the smoke are shown in FIG. 10 and FIG. 11.

(Measurement Conditions of Analyzer)

Apparatus: GC [Agilent 6890N] [Agilent 5973inert] GC method (1 μL of sample liquid was introduced) Apparatus Feed port; not divided, heater; 200° C., pressure; 5.5 psi, total flow rate; 50 mL/min, purge flow into divided bent; 40 mL/min Column; Agilent DB-WAX [30 m×530 μm×1.00 μm], constant flow rate, outlet; vacuum He flow: pressure; 5.5 psi, flow rate; 7.3 mL/min, average velocity; 52 cm/sec Oven:

TABLE 2

| | Temperature gradient | Temperature (° C.) | Retention time (min) |
|---|---|---|---|
| Initial conditions | — | 60 | 0 |
| | 5° C./min | 170 | 10 |
| | 10° C./min | 200 | 5 |

Example 2

A first tobacco filler was prepared by mixing at a ratio of 10.5 mg of a volatile flavor-containing material that was similar to that of Example 1 with respect to 102 mg of general blend cut tobacco (ratio of the volatile flavor-containing material: 9.3% by weight). Next, a tobacco rod in which the first tobacco filler was disposed in the distal end portion (length: 10 mm (17.5% of the full length of the tobacco rod)) and the proximal end portion (length: 10 mm (17.5% of the full length of the tobacco rod)) and a second tobacco filler (the above-mentioned general blend cut tobacco) was disposed in the center portion (length: 37 mm (64.9% of the full length of the tobacco rod)) was prepared.

Thereafter a cigarette was prepared in similar procedures to those of Example 1 by using this tobacco rod, this cigarette was stored for one month and then smoked, and the amount of the menthol contained in the smoke at every number of puffs was determined according to similar procedures to those of Example 1.

[Comparative Example 1]

A tobacco rod in which the second tobacco filler was disposed in the entire region was prepared. Next, 14 mg of menthol was added by using a syringe so that the menthol developed over the entire region of the distal end portion (length: 10 mm (17.5% of the full length of the tobacco rod)) of the prepared tobacco rod.

Thereafter, using this tobacco rod, a cigarette for comparison was prepared by similar procedures to those of Example 1, the obtained cigarette was smoked, and the amount of the menthol contained in the smoke at every number of puffs was determined according to similar procedures to those of Example 1. Furthermore, similar determination was performed for a cigarette that had been stored for one month after preparation.

[Comparative Example 2]

A first tobacco filler was prepared by mixing at a ratio of 21 mg of volatile flavor-containing material that was prepared in similar procedures to those of Example 1 with respect to 579 mg of general blend cut tobacco (ratio of the volatile flavor-containing material: 3.5% by weight). This first tobacco filler was wrapped with a cigarette paper to prepare a tobacco rod in which the first tobacco filler was disposed in the entire region.

Thereafter a cigarette was prepared in similar procedures to those of Example 1 by using this tobacco rod (FIG. 7), this cigarette was stored for one month and then smoked, and the amount of the menthol contained in the smoke at every number of puffs was determined according to similar procedures to those of Example 1.

[Comparative Example 3]

A first tobacco filler was prepared by mixing at a ratio of 21 mg of the volatile flavor-containing material that was the same ratio as Example 1 with respect to 102 mg of general blend cut tobacco (ratio of the volatile flavor-containing material: 17% by weight). Next, a tobacco rod in which this first tobacco filler was disposed in the proximal end portion (length: 10 mm (17.5% of the full length of the tobacco rod)) and a second tobacco filler (the above-mentioned general cut tobacco) was disposed in the distal end portion and center portion (total length: 47 mm (82.5% of the full length of the tobacco rod)) was prepared.

Thereafter a cigarette was prepared in similar procedures to those of Example 1 by using this tobacco rod (FIG. 8), this cigarette was stored for one month and then smoked, and the amount of the menthol contained in the smoke at every number of puffs was determined according to similar procedures to those of Example 1.

[Discussion of Results of Determination of Menthol]

(1) Discussion of Change of Amount of the Menthol in the Smoke by Storage

FIG. 10 is a graph in which the determined values of the amount of the menthol in the smoke for the cigarette immediately after the preparation in Example 1 (the line shown by solid triangles in the drawing) and the determined values of the amount of the menthol in the smoke of this cigarette after one month of storage (the line shown by solid circles in the drawing), as well as the determined values of the amount of the menthol in the smoke of the cigarette immediately after the preparation in Comparative Example 1 (the line shown by open triangles in the drawing) and the determined values of the amount of the menthol in the smoke of this cigarette after one month of storage (the line shown by open circles in the drawing) are plotted at every number of puffs.

It is found that the amount of the menthol in the smoke at the initial period of smoking (at the times of first and second puffs) was large in the cigarette of Comparative Example 1 immediately after the preparation, whereas the amount of the menthol in the smoke was decreased from the initial period to the end period of smoking after one month of storage of this cigarette.

On the other hand, in the cigarette of Example 1, the volatile flavor-containing material suppressed the volatilization of the menthol even after one month of storage, and thus the amount of the menthol in the smoke could be retained at a high degree from the initial period to the end period of smoking, specifically at the initial period of smoking.

(2) Discussion of Change in Amount of the Menthol in the Smoke Depending on Difference of Disposition of First Tobacco Filler FIG. 11 is a graph in which the amounts of the menthol in the smoke for the cigarettes of Examples 1 and 2 and Comparative Examples 2 and 3 after one month of storage after preparation are each plotted at every number of puffs. Here, the open square series show the determined values in Example 1 (the same as the solid circle series in FIG. 10), the solid triangle series show the determined values in Example 2, the open circle series show the determined values in Comparative Example 2, the open rhombus series show the determined values in Comparative Example 3, and the open triangle series show the expected values in Example 2.

In the cigarette of Comparative Example 2 in which the first tobacco filler was disposed in the entire region of the tobacco rod, and the cigarette of Comparative Example 3 in which the first tobacco filler is disposed in the proximal end portion (the region at 10 mm from the proximal end of the tobacco rod), the amount of the menthol in the smoke was gradually increased according to the number of puffs, but the amount of the menthol in the smoke at the initial period of smoking, which is one object of the present invention, could not be increased significantly.

On the other hand, in the cigarette of Example 2 in which the first tobacco filler was disposed in the distal end portion (the region at 10 mm from the distal end of the tobacco rod) and the proximal end portion (the region at 10 mm from the proximal end of the tobacco rod), the amount of the menthol in the smoke at the initial puff was estimated to be about 0.05 mg by the original expectation; however, in contradiction to the expectation, the amount of the menthol in the smoke at the initial period of smoking (around the first and second puffs) was significantly large, and the amount of the menthol at the initial puff was notably large.

What is claimed is:

1. A cigarette comprising:

a tobacco rod in which a tobacco filler containing cut tobacco is wrapped with a cigarette paper, the tobacco rod being constituted by a distal end portion, a proximal end portion and a center portion; and a filter, the proximal end portion being connected to the filter, wherein the distal end portion comprises a sheet-shaped volatile flavor-containing material comprising a volatile flavor incorporated in a gel of a polysaccharide, the center portion does not comprise the sheet-shaped volatile flavor-containing material, and the proximal end portion comprises the sheet-shaped volatile flavor-containing material.

2. The cigarette according to claim 1, wherein the sheet-shaped volatile flavor-containing material is sheet-shaped cut pieces having a similar size to that of the cut tobacco, and the sheet-shaped cut pieces are present in the tobacco filler.

3. The cigarette according to claim 1, wherein the sheet-shaped volatile flavor-containing material is present inside of the cigarette paper such that the tobacco filler is wrapped by the sheet-shaped volatile flavor-containing material.

4. The cigarette according to claim 1, wherein the distal end portion accounts for 8.8 to 35.1% of the full length of the tobacco rod, and the proximal end portion accounts for 8.8 to 35.1% of the full length of the tobacco rod.

5. The cigarette according to claim 4, wherein the distal end portion accounts for 17.5% of the full length of the tobacco rod, and the proximal end portion accounts for 17.5% of the full length of the tobacco rod.

6. The cigarette according to claim 1, wherein the volatile flavor is menthol.

7. The cigarette according to claim 1, wherein the volatile flavor is contained in the tobacco rod by 0.75 to 225 mg.

8. The cigarette according to claim 1, wherein the polysaccharide is a single component system of carrageenan, agar, gellan gum, tamarind gum, psyllium seed gum or konnyaku glucomannan, or a composite system of a combination of two or more components selected from the group consisting of carrageenan, locust bean gum, guar gum, agar, xanthane gum, gellan gum, tamarind gum, tara gum, konnyaku glucomannan, starch, cassia gum and psyllium seed gum.

* * * * *